US005586918A

United States Patent [19]

Chemin

[11] Patent Number: 5,586,918

[45] Date of Patent: Dec. 24, 1996

[54] CONNECTOR HAVING A GRID FOR SECONDARY LOCKING OF TERMINALS

[75] Inventor: Gilles Chemin, Toulouse, France

[73] Assignee: Framatome Connectors International, Paris, France

[21] Appl. No.: 574,965

[22] Filed: Dec. 19, 1995

[30] Foreign Application Priority Data

Dec. 19, 1994 [FR] France ..... 94 15245

[51] Int. Cl.[6] ..... H01R 13/514

[52] U.S. Cl. ..... 439/752; 439/595

[58] Field of Search ..... 439/752, 595, 439/744

[56] References Cited

U.S. PATENT DOCUMENTS

| | | | |
|---|---|---|---|
| 5,037,336 | 8/1991 | Betsui | 439/752 |
| 5,322,456 | 6/1994 | Yagi et al. | 439/752 |
| 5,441,427 | 8/1995 | Yamada | 439/752 |

*Primary Examiner*—Gary F. Paumen

*Assistant Examiner*—T. C. Patel

*Attorney, Agent, or Firm*—Pollock, Vande Sande & Priddy

[57] ABSTRACT

The connector has an insulating body of rectangular cross-section formed with at least one row of passages extending parallel to a plugging direction, each passage being formed with a backwardly directed shoulder. At least one side wall of each passage is cut out to form a detent whose resilience tends to hold it in a position in which it projects into the respective passage. Contact terminals are received in the passages and each sized to be retained by the respective detent against the respective shoulder. A unitary locking grid has an end wall which contacts a front end face of the body and is formed with holes in register with the passages, two side flanks that are spaced apart so as to straddle those two walls of the body which are orthogonal to the row, and two side flaps that are connected to the end wall by flexible portions, and that are designed to contact the outside walls of the body which are parallel to the row. Each side flap has a plurality of end internal extensions for penetrating through windows in the said insulating body to retain the grid and lock the terminals of a row. The flaps prevent the detents from moving away from a position in which they project into the passages.

5 Claims, 2 Drawing Sheets

FIG.4.
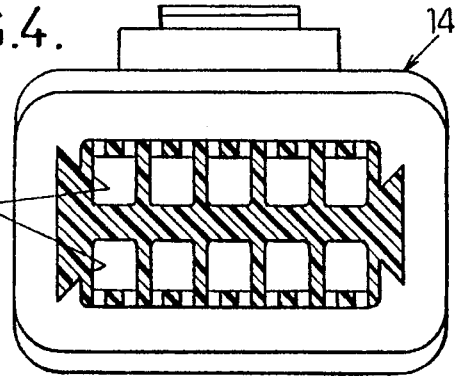
FIG.5.
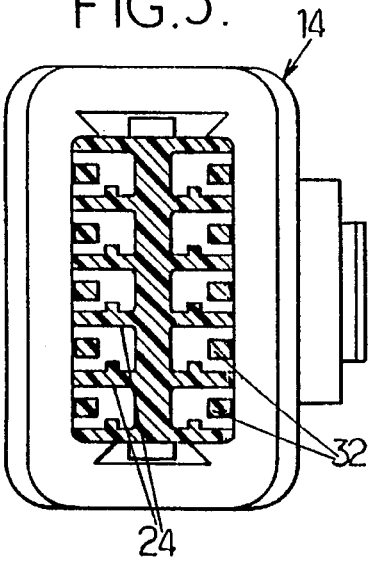
FIG.6.
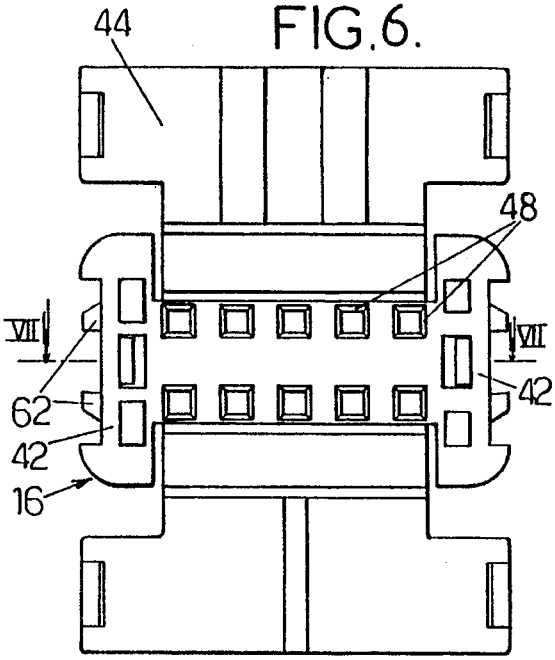
FIG.8.
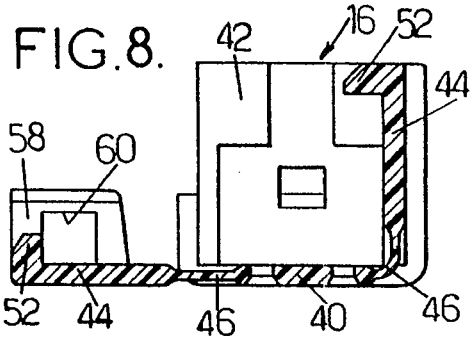
FIG.7.
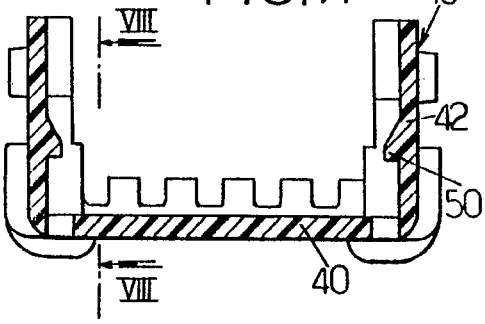
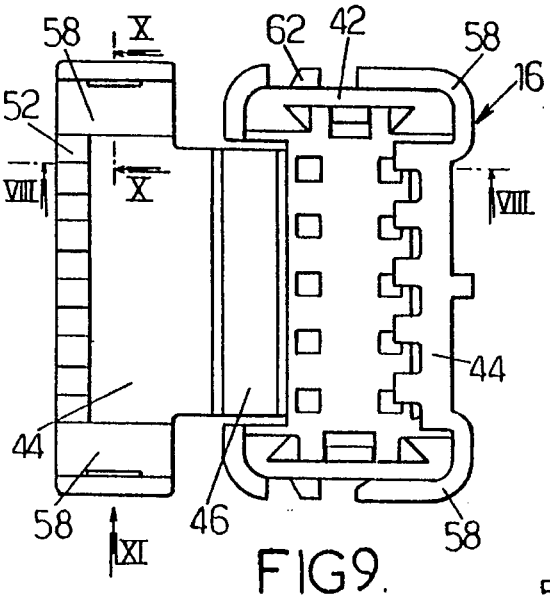
FIG9.
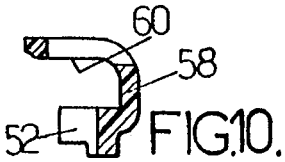
FIG.10.
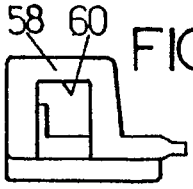
FIG.11.

CONNECTOR HAVING A GRID FOR SECONDARY LOCKING OF TERMINALS

BACKGROUND OF THE INVENTION

The present invention relates to electrical connectors apt to be coupled to a complementary connector by plugging. More particularly, it relates to an electrical connector of the kind having an insulating body of rectangular cross-section formed with at least one row of passages extending parallel to the plugging direction and designed to receive respective contact terminals, with at least one side wall of the passages being cut out to form detents whose resilience tends to hold them in a position in which they project into the passages where they retain the terminals in abutment against a backwardly-directed shoulder formed in each passage.

In miniature connectors, which are being used more and more in electronics, in particular in cars, the detents are very thin and fragile. They run the risk of flexing or breaking and thus of allowing the contacts to escape.

Connectors have already been proposed that further include a part, often referred to as a "grid", that is fitted over the front end portion of the body and that prevents the detents from flexing and releasing the contacts once the grid is in place. The grid is generally designed so that it cannot be inserted unless all terminals are fully engaged and locked in place. Otherwise the grid comes into abutment against detents that are outwardly flexed.

SUMMARY OF THE INVENTION

An object of the invention is to provide a connector having a grid that performs the above functions in simple manner, and that also provides locking that may be referred to as "secondary" which is much more secure than the locking performed by the detents, which may be referred to as "primary".

Consequently, the invention proposes a connector having a grid and of the kind defined above, wherein the locking grid is a single part having an end wall designed to contact a front end face of the body and formed with holes in register with the passages, two side flanks that are spaced apart so as to straddle those two walls of the body which are orthogonal to the row(s), and two side flaps that are connected to the end wall by flexible portions, and that are designed to contact the outside walls of the body which are parallel to the row(s), each side flap having a plurality of end internal extensions for penetrating through windows in the body to retain the grid and lock the terminals of a row, said flaps also preventing the detents from moving away from the position in which they project into the passages.

The above dispositions and others will appear more fully on reading the following description of a particular embodiment of the invention, given by way of non-limiting example. The description refers to the accompanying drawings.

BRIEF DESCRIPTION OF THE DRAWINGS

FIG. 4 is a view of the connector body in cross-sectional on line IV—IV of FIG. 1;

FIG. 5 is a cross-sectional view of the connector body on the plane marked V—V in FIG. 2;

FIG. 6 is a view from beneath of the grid of the connector in spread condition, i.e. in the state it is on being unmolded;

FIG. 7 is a cross-section on line VII—VII of FIG. 6;

FIG. 8 shows the grid in cross-section on line VIII—VIII of FIG. 7 or of FIG. 9, with one of its flaps spread out and the other folded down;

FIG. 9 is a plan view of FIG. 8;

FIG. 10 is a detail view in cross-section on line X—X of FIG. 9; and

FIG. 11 is a detail view as seen in the direction of arrow XI in FIG. 9.

DETAILED DESCRIPTION OF A PREFERRED EMBODIMENT

Figure 2:
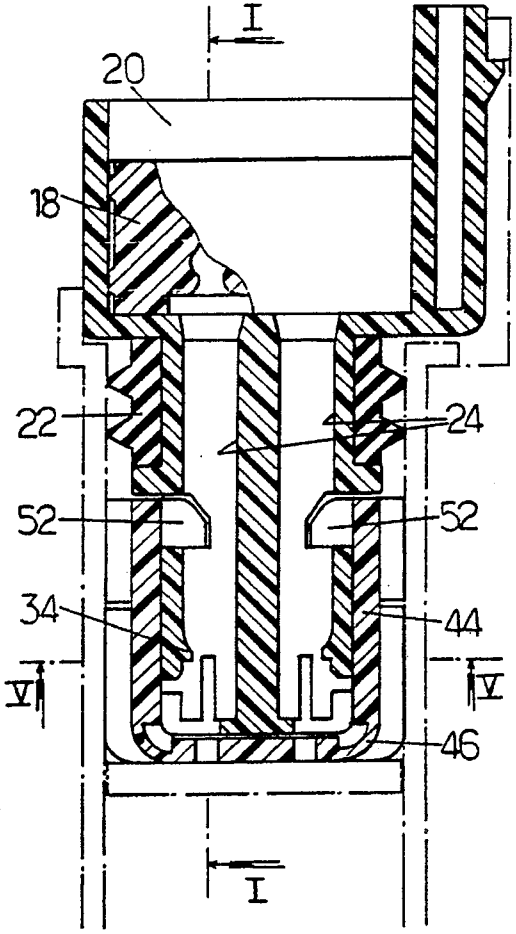
FIG. 2 also shows a complete connector, in cross-section on line II—II of FIG. 1.
Figure 1:
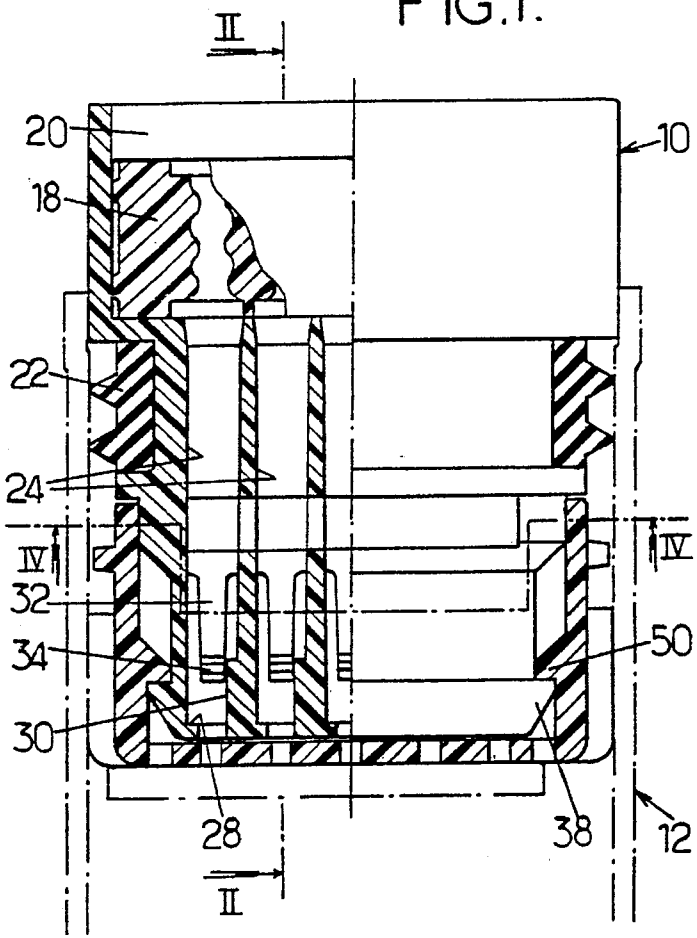
FIG. 1 shows a complete connector, in cross-section on line I—I of FIG. 2, the body of the connector being shown in elevation on the right of the figure.

The connector 10 shown in FIGS. 1 and 2 is designed to be coupled with a complementary connector by being plugged therewith, and the outline of the complementary connector is represented diagrammatically by chain-dotted lines. By way of example, the complementary connector 12 may be of the type described in the patent application filed on the same day as the present application, assigned to the same assignee, under the title "Connector having a terminal-locking grid". It is assumed below that the connector 10 is designed to receive cage-shaped female contact terminals 13 (FIG. 3), whereas the complementary connector 12 is designed to receive contact terminals in the form of tongues (not shown). However this disposition is not exclusive in any way.

The connector 10 may be regarded as comprising a body 14 of insulating material (generally filled plastics material) manufactured by molding, a locking grid 16, a grommet 18, and a plate 20 for holding and compressing the grommet. The connector 10 as shown also has an annular elastomer gasket 22 between confronting faces for providing sealing with the complementary connector 12. The grommet 18, the plate 20, and the gasket 22 are not described further since they may be conventional in structure and they are not directly concerned by the invention.

The body 14 of the connector 10 as shown is formed with two rows of passages 24 extending parallel to the insertion direction. These passages are of substantially constant rectangular cross-section along their entire length. They open out through the front face of the body via holes of small size that are large enough to pass the tongues of the connector 12. A shoulder 28 between each passage 24 and the corresponding hole constitutes an abutment for limiting displacement of the terminals 13 in a forward direction. The body shown in FIG. 1 has a longitudinal rib 30 in each passage. The rib is designed to engage a notch in the corresponding terminal and to allow the terminal to be inserted in one orientation only.

In each of the walls of the body parallel to the rows, detents 32 are cut out, each having an inwardly directed catch 34 projecting into the passage when the detent is in rest position. The back of the catch has a slope enabling the terminal 13 to be inserted. The front of the catch has an abrupt face for preventing the terminal 13 being withdrawn once the catch has snapped into a locking window 36 of the terminal.

The two faces of the body that are orthogonal to the rows have respective latching tabs 38 each having a sloping front face and an abrupt back face for retaining the locking grid 16, as explained below.

The locking grid 16 shown in FIGS. 6 to 11 is designed to be suitable for being manufactured as a single piece by molding, generally of plastics material that may contain a filler. The grid may be regarded as having an end wall 40 designed to contact the front face of the body, two flanks extending at 90° to the end wall and designed to latch onto the tips 38, and two foldable flaps 44 arranged to be applied against the faces of the body that are parallel to the rows and to lock the terminals. The flaps 44 are connected to the end wall via portions of the grid that are thinner than the remainder of the grid and that serve to constitute flexible hinges 46.

The end wall 40 of the grid is of substantially constant thickness and it is formed with holes 48 placed in register with the passages and of sufficient size to allow the tongues of the complementary connector 12 to pass through. Each of the two flanks 42 has an internal tab 50 for latching onto a respective one of the tabs 38 of the body. In order to facilitate engagement of the grid, the tabs 50 have sloping leading faces (leading in the direction in which the grid is engaged on the body). In contrast, their trailing faces are abrupt and at a distance from the end wall such that the end wall of the grid substantially contacts the front face of the body when the tabs 38 and 50 are latched together (FIGS. 1 and 2). The resilience of the zones coupling the flanks to the end wall is sufficient to allow engagement to take place.

Figure 3:
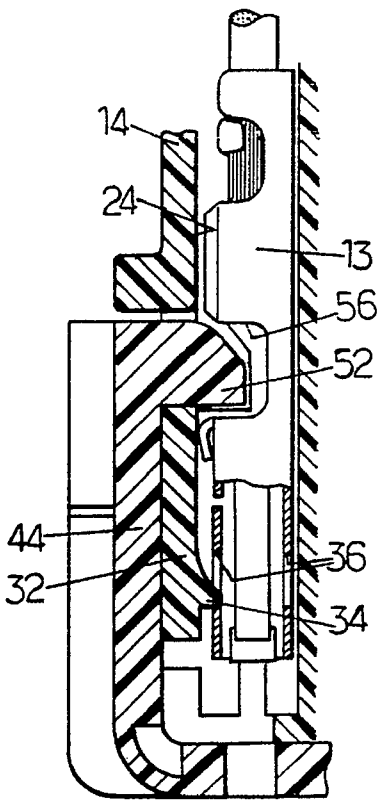
FIG. 3 shows a fragment of FIG. 2 on a larger scale, with a contact terminal in place.

Each of the flaps 44 has a central portion designed to bear against a face of the body that is parallel to the rows. Each central portion has internal projections 52 at its end, each projection being designed to pass through a corresponding window of the body and engage in a notch 56 of a respective terminal in order to lock the terminal (FIG. 3).

Means are provided for retaining the flaps 44 in the position where they lock the terminals. In the example shown in the figures, these means comprise two wings 58 on each flap 44. The wings are bent through 90° so that their end portions bear against the outside faces of the flanks 42. Openings 60 in the wings then snap onto outwardly-directed catches 62 integrally molded with the flanks 42.

The way in which the connector is assembled can be seen from the description above. The terminals fitted with their wires passing through the block 18 are inserted one by one until each terminal is retained by a respective detent 32 which provides primary locking that is sufficient to prevent the terminals from escaping. The grid is then engaged on the body while its flaps 44 are in the deployed state until the tabs 38 and 50 come into mutual engagement. The flaps 44 are then folded down. A flap cannot be folded right down unless all of the detents carried by the adjacent face of the body are in the position shown in FIG. 2. Once the flaps 44 are in the position shown in FIG. 2, their projections 52 prevent the terminals 13 being withdrawn, thereby providing secondary locking. In addition, they reinforce the primary locking because they prevent the detents from flexing outwards. After the flaps 44 have been folded down, the openings 60 engage on the corresponding catches 62 and lock the grid on the body.

The grid is typically designed so that it can be manufactured by molding in a mold having a small number of moving slides. For that purpose, the grid is molded in the deployed state as shown in FIG. 6. As shown in FIGS. 6, 8, and 9, all of the spaces for receiving matter to constitute the internal projections can be defined by two molding flanks.

The invention is not limited to the particular embodiment shown and described by way of example. For example, the body could have more than two rows of passages: then the grid will include additional partitions extending transversely to the end wall and designed to engage in slots of the body for the purpose of retaining the detents of the middle row(s) of passages.

I claim:

1. A connector designed to be coupled to a complementary connector by plugging, comprising:

an insulating body of rectangular cross-section formed with at least one row of passages extending parallel to a plugging direction, each said passage being formed with a backwardly directed shoulder, at least one side wall of each of said passages being cut out to form a detent whose resilience tends to hold a catch in a position in which it projects into the respective passage;

a plurality of contact terminals received in said passages and each sized to be retained by the respective catch against the respective shoulder; and a unitary locking grid dimensioned to be fitted against a front end face of said body, having an end wall designed to contact the front end face and formed with holes in registry with the passages, two side flanks that are spaced apart so as to straddle two walls of the body which are orthogonal to the row, and two side flaps that are connected to the end wall by flexible portions, and that are designed to contact outside walls of the body which are parallel to the row, each said side flap having a plurality of end internal extensions for penetrating through windows in said insulating body to retain the grid and lock the terminals of said row, said flaps being shaped to prevent the catches from moving away from a position in which they project into the passages.

2. Connector according to claim 1, wherein said flanks are formed with inwardly directed tabs each arranged to engage a respective tab of said body for latching said grid.

3. Connector according to claim 1, comprising two said rows, wherein the detents associated with each said row are cut out in one of the two side walls parallel to the rows.

4. A connector according to claim 1, wherein said flaps are connected to the end wall by portions of the grid that are thinner than the remainder of the grid and constitute flexible hinges.

5. A connector according to claim 4, wherein each of said flaps has a central portion arranged to bear against said front end face of said insulating body that is parallel to said row and two wings bent through 90° so that end portions thereof bear against outside faces of said flanks, said wings having openings arranged to snap onto outwardly-directed catches of said flanks.

* * * * *